US008925269B1

(12) United States Patent
Beaudin

(10) Patent No.: US 8,925,269 B1
(45) Date of Patent: Jan. 6, 2015

(54) WALL PANEL ASSEMBLY, METHODS OF MANUFACTURE AND USES THEREOF

(76) Inventor: Caleb J. Beaudin, Lake Oswego, OR (US)

( * ) Notice: Subject to any disclaimer, the term of this patent is extended or adjusted under 35 U.S.C. 154(b) by 317 days.

(21) Appl. No.: 13/034,649

(22) Filed: Feb. 24, 2011

Related U.S. Application Data

(60) Provisional application No. 61/307,614, filed on Feb. 24, 2010.

(51) Int. Cl.
*E04C 1/00* (2006.01)

(52) U.S. Cl.
USPC ..... 52/309.5; 52/309.7

(58) Field of Classification Search
USPC ..... 52/309.5, 309.7, 309.16, 506.05
See application file for complete search history.

(56) References Cited

U.S. PATENT DOCUMENTS

| | | | | |
|---|---|---|---|---|
| 4,628,650 | A | 12/1986 | Parker | |
| 4,702,058 | A | 10/1987 | Bennett | |
| 5,771,645 | A | 6/1998 | Porter | |
| 5,953,883 | A * | 9/1999 | Ojala | 52/794.1 |
| 6,279,284 | B1 * | 8/2001 | Moras | 52/408 |
| 6,308,491 | B1 | 10/2001 | Porter | |
| 2008/0203244 | A1 * | 8/2008 | Nagus | 248/68.1 |
| 2009/0100780 | A1 | 4/2009 | Mathis et al. | |
| 2009/0205277 | A1 * | 8/2009 | Gibson | 52/309.9 |
| 2010/0043327 | A1 | 2/2010 | Rothwell | |
| 2010/0107539 | A1 * | 5/2010 | Martens et al. | 52/506.05 |
| 2010/0325999 | A1 * | 12/2010 | Devalapura | 52/506.05 |

* cited by examiner

*Primary Examiner* — Andrew J Triggs
(74) *Attorney, Agent, or Firm* — Jean Kyle

(57) ABSTRACT

Flat faced stud members adhered to one face of a rigid, planar core and sheathing adhered to an opposing face of that core create a wall panel. The adhesive used to adhere the sheathing to the core is non-continuous and follows a pattern used to attach the stud members to the core. A top plate and a bottom plate are adhered to the core and adhered to the stud members. A cap connects to at least one of the plates and overlays an end of the sheathing. The cap, plates, core, stud members, and sheathing bound by adhesive create a cohesive assembly which is structurally considered a single unit.

16 Claims, 5 Drawing Sheets

WALL PANEL ASSEMBLY, METHODS OF MANUFACTURE AND USES THEREOF

CROSS-REFERENCE TO RELATED APPLICATIONS

This application claims the benefits of U.S. Provisional Application No. 61/307,614, filed Feb. 24, 2010, the disclosure of which is hereby incorporated by reference in its entirety including all figures, tables and drawings.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING COMPACT DISC APPENDIX

Not Applicable.

BACKGROUND OF THE INVENTION

The advantages of building a thermally sound structure are becoming even more important with increasing energy costs. Thermally sound structures prevent heat loss decreasing utility bills and increasing energy efficiency. Standard building methods address the issue but these methods often come at a cost. Structural insulated panels, or SIPs, offer high energy efficiency but are costly. The base cost of these panels is high and their cost escalates with the additional time and labor required to install them. Door and window cutouts require time consuming and toxic foam scooping. Wall erection, panel fitting and field modifications are difficult and require specialized equipment. Wiring and other rough-in systems become complicated. The panel drawings and design-specific manufacturing processes add extra costs and a 1-3 month delay. The structural adhesive has been known to fail when exposed to moisture. Attempts have been made to address these many issues (see, for example, U.S. Pat. Nos. 4,628,650; 4,702,058; 5,771,645; and U.S. Pat. No. 6,308,491 B1, and United States Published Patent Application Nos. 2009/0100781 A1; 2009/0205277 A1; and 2010/0043327). Panel production of SIPs however involves excessive waste, which also drives up the cost. SIP walls are expensive at roughly $8.50/square foot (SF) of wall, or roughly double the cost of a traditionally framed wall.

Traditional wood framing with fiberglass battens or blown-in insulation is prominent and cost-effective at $4.00/SF of wall, but offers a poorly insulated building envelope and allows thermal bridging and air infiltration. Structures built in this manner may meet the threshold thermal requirements of the International Building Code, however owners incur substantially higher utility bills and excessive fuels are spent on climate control.

Traditional wood framing with sprayed urethane insulation offers good thermal performance; however there is thermal bridging across wood stud members. In addition to toxic off gassing, the major drawback of this method is the cost at roughly $7.00/SF of wall.

Non-traditional wood framing methods such as creating double stud walls, wide plates with staggered studs or rigid foam sheathed walls are viable energy efficiency options, however each method has its own drawbacks, thus complicating the building process and the associated engineering. These methods are also cost prohibitive most being priced at greater than $7.00/SF of wall.

Insulated concrete forms (ICFs), concrete block (CMU) or concrete/foam sandwich panels offer solid energy efficiency; however labor, coordination and cost are much more extensive than traditional methods at around $12/SF of wall. Furthermore, concrete wall construction has not found a viable solution to complications arising in electrical and plumbing rough-in phases that follow.

While there are currently viable wall systems in place offering sound thermal performance, these options each entail their own unique set of drawbacks and all are substantially higher priced than the traditional stick-framed structure insulated with fiberglass batting. For these reasons, builders have found little incentive to deviate from the prominent, yet energy-inefficient norm of stick framed construction.

A need remains for a wall panel system that incorporates the advantages of shell framing methods, yet eliminates nearly all of the drawbacks. The wall panel system should be cost-effective, preferably around $5.00/SF of wall, readily available for same day install, easily customizable and able to be erected on-site, integrate seamlessly with traditional framing and meet engineering, building code & local requirements.

All patents, patent applications, provisional patent applications and publications referred to or cited herein, are incorporated by reference in their entirety to the extent they are not inconsistent with the teachings of the specification.

BRIEF SUMMARY OF THE INVENTION

The wall panel assembly of the subject invention takes on unique structural characteristics. Interior flat faced stud members are adhered to an generally planar, rigid insulating core, which is in turn adhered to sheathing. Plates are adhered to the stud members, the core and the sheathing. When adhered to one another, the individual members of the panel work jointly as a wall assembly system where the structural properties of each component can be considered collectively rather than individually. A collective view of the structural properties is required for this system to meet and exceed the engineering requirements of a wall panel. In the subject wall assembly, bearing loads are dispersed over the top and bottom plates and also over a cap plate. The interior stud members, the exterior sheathing and even the rigid core all contribute to the bearing capacity, the sheer strength and the out-of-plane wind loads.

DETAILED DESCRIPTION OF THE INVENTION

The insulated wall panel assembly of the subject invention is a manufactured structural building product that provides a thermally sound building envelope at costs competitive with available alternatives. The subject assembly is useful in constructing new residences and commercial buildings up to 4 stories tall. Further, the wall system is conducive to additions and remodels alike. Panels of the subject assembly are ideal for large structures with long runs of straight, standard height walls. These panels are provided in standard sizes with standardized window and door cut-outs or are easily customized on-site as the structure is erected.

Figure 1:
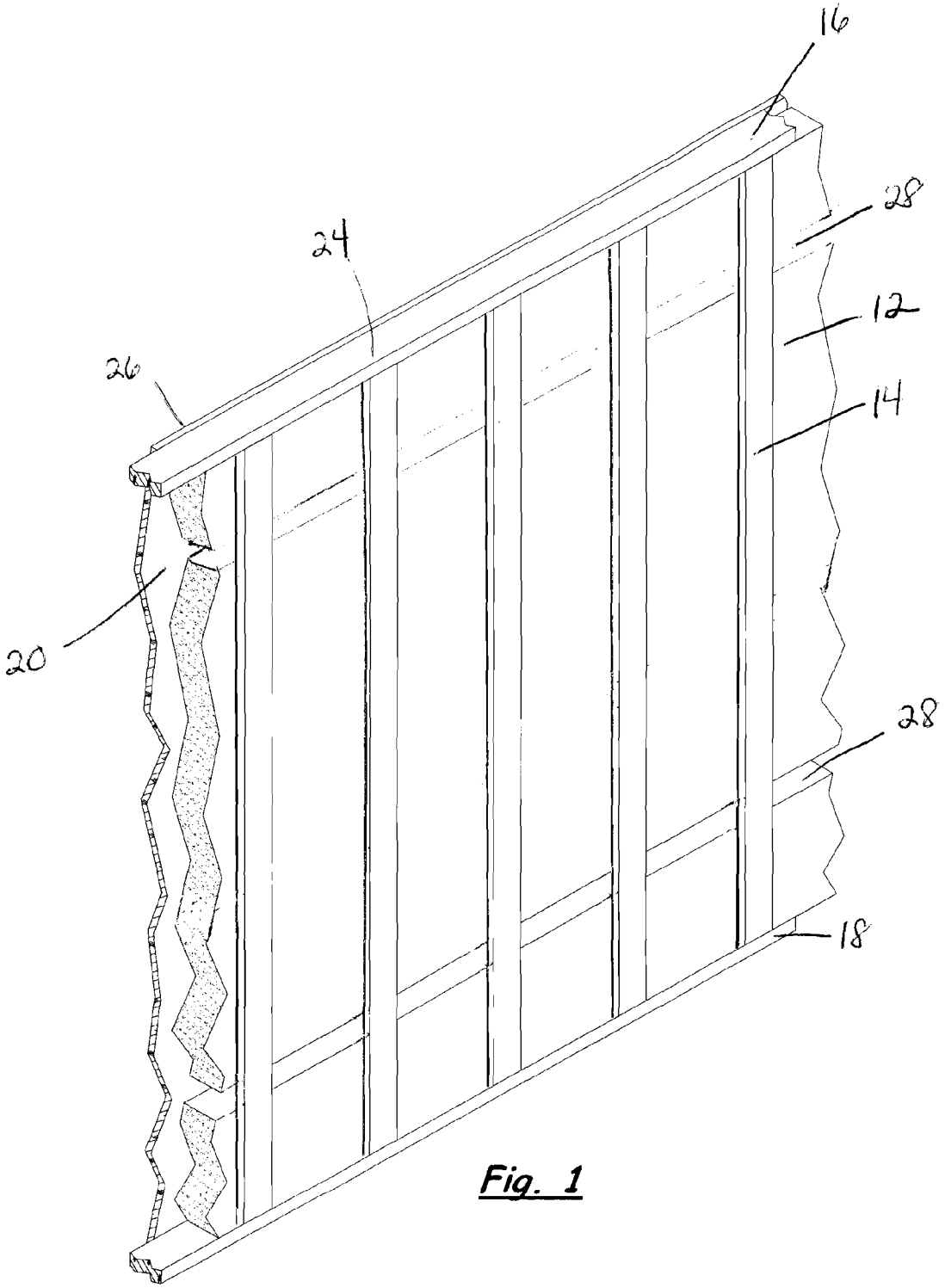
FIG. 1 is a partial perspective view of a preferred embodiment of a wall panel of the insulated wall panel assembly of the subject invention.
Figure 3:
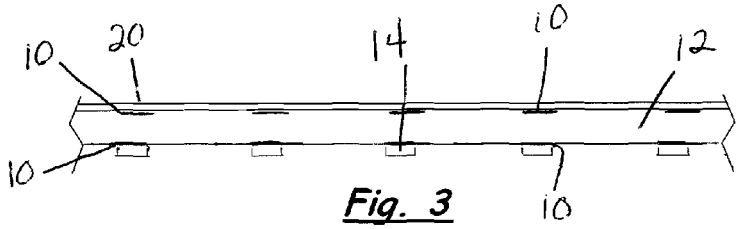
FIG. 3 is a partial top plan view of a preferred embodiment of a wall panel of the insulated wall panel assembly of the subject invention.
Figure 4:
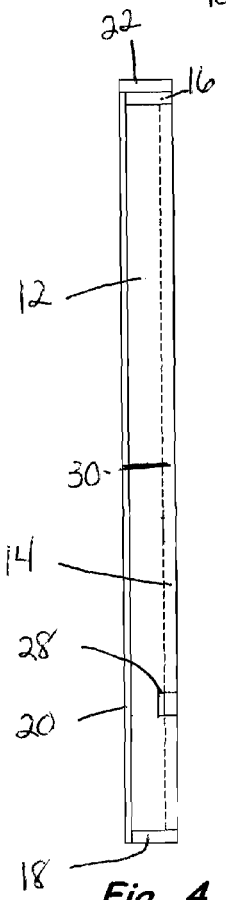
FIG. 4 is a cross-sectional side elevational view of a preferred embodiment of a wall panel of the insulated wall panel assembly of the subject invention.
Figure 2:
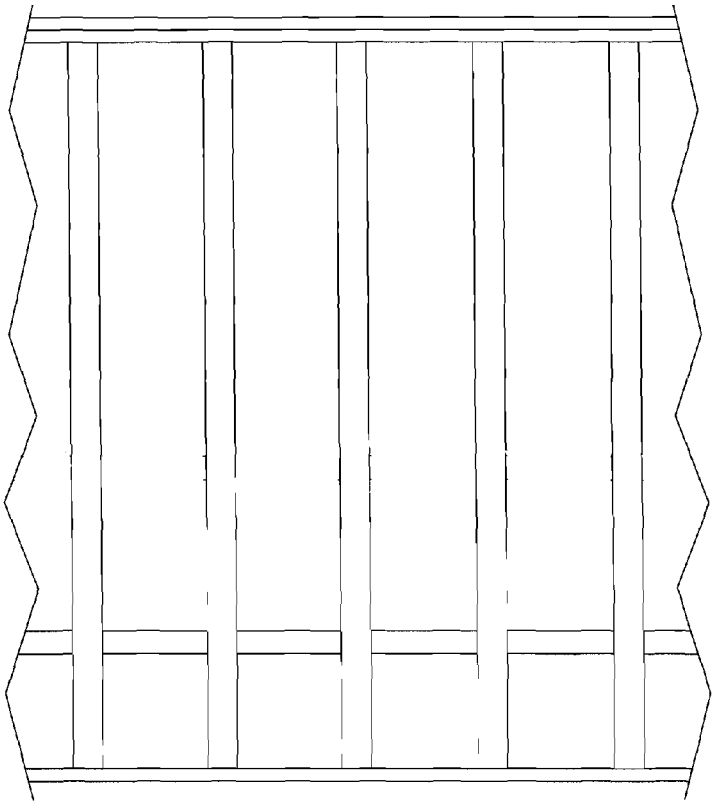
FIG. 2 is a partial front facing view of a preferred embodiment of a wall panel of the insulated wall panel assembly of the subject invention.

The insulated wall panel assembly of the subject invention comprises a generally planar insulating core 12 (FIG. 1). Studs 14, laying flat, are adhered to one face of the core. The studs are spaced along the width of the core. Top and bottom plates cover the ends of the core and overlay the ends of the studs. Sheathing 20 is adhered to the opposing face of the core and overlays the plates. The sheathing is adhered to the core non-continuously in strips that correspond to the positions of the studs on the opposite face. A cap 22 extends along an end plate overlaying the sheathing to provide a unitary wall panel. Thermal bridging across the panel is reduced since the studs do not bridge the foam and air infiltration is prevented when most of the connections are secured with adhesive. Preferred embodiments of the assembly are shown in FIGS. 1-9.

The insulating core 12 of the panels of the subject invention is generally planar and preferably rigid. In a particularly preferred embodiment, the insulating core is rigid foam and can be composed of materials including, but not limited to, expanded polystyrene (EPS), POLYISO™ Urethane Board or like products that offer adequate structural integrity and insulation properties. The rigid foam acts as an insulating medium. In addition to eliminating thermal bridging, the insulating core also contributes to the structural integrity of the panel assembly and further acts as an air barrier. The solid surface of a foam core eliminates air infiltration and minimizes thermal losses through the wall surface.

Stud members 14 are adhered to one face of the insulating core. The stud members can be typical 2×4 studs turned on the flat and spaced along the core. Therefore, in this embodiment, by way of example, it is the 3¼ inch sides of the stud members that are adhered to the insulating core. Stud members comprise the inboard side of the assembly and provide most of the structural bearing, lateral load and out-of-plane sheer integrity. While 2×4 wood studs are the preferred interior stud members, suitable alternatives can include, but are not limited to, 2×6 wood studs, steel studs or engineered wood studs. The flat surface of the stud members can also function as backing or blocking for gypsum board, other interior finish materials, cabinetry, curtains, wall hangings, wall fixtures, etc. Where, for example, gypsum board is applied to the stud members to form an interior wall, the space between the core and the gypsum board created by the stud members can be used as a vertical electrical or plumbing chase, or for the installation of in-wall heaters or radiators. Further, the space can be vented at the top and bottom to create a convection loop within the wall. The stud members of the insulated wall panel assembly of the subject invention provide rigidity, strength and backing.

Plates 16, 18 are adhered to the core and comprise the top and bottom members of the panels of the insulated wall panel assembly of the subject invention. In the exemplified embodiment, the plates are 2×6 linear wood studs, suitable alternatives include, but are not limited to, laminated or engineered wood, linear composites, or foam filled tubing. In a vertically disposed wall panel, the base plate 18 commonly attaches the panel to the foundation or floor of the structure. The top plate 16 commonly attaches the panel to the trusses, rafters or the next story. Both plates directly connect the sheathing 20 to the inboard flat studs 14. The bearing load is dispersed over the top and bottom plates. The plates 16, 18 are preferably connected to the interior flat-faced studs 14 via fasteners or by way of nailing pattern 24. Nailing pattern 24 can vary by project specific engineering requirements. A typical nailing pattern of this nature can include 3-16D smooth shank nails at each connection location. In a particularly preferred embodiment, the plates are connected to the stud members by press plates or wave plates.

Sheathing 20 is adhered to the core 12 and is preferably a continuous sheet good material such as oriented strand board (OSB) or plywood. This member constitutes the outboard surface of the panel and provides a surface to which the finished siding is then attached. The sheathing also contributes to the structural properties of the assembly as a whole, providing bearing and sheer value. The sheathing 20 is preferably connected to plates 16, 18 via fasteners or by way of nailing pattern 26. Nailing pattern 26 can vary by project specific engineering requirements; however a typical nailing pattern of this nature can include 8D smooth shank nails at 6" centers continuous along the horizontal length of the plates 16, 18.

A cap 22 (FIG. 4) overlays the top surface of the panel assembly (including the sheathing 20) and disperses the bearing load over the vertical structural members of the panel below, i.e. the stud members 14 and the sheathing 20. The cap can be milled from dimensional lumber ripped to the width of the panel assembly and completes the wall panel assembly. The cap plate 22 is preferably connected to the top plate 18 by way of nailing pattern 24. Nailing patterns can vary by project specific engineering requirements; however a typical nailing pattern of this nature can include 2-16D smooth shank nails at 6" centers along the horizontal length of the cap plate 22. Cap plate 22 is further preferably connected to top plate 18 by way of bonding agent or adhesive in order to prevent air infiltration between members.

Flat facing stud members 14, top and bottom plates 16, 18 and sheathing 20 are adhered to the insulating core 12 by an adhesive 10. In the exemplified embodiment, the 3½" flat surface of typical stud members 14 are adhered to the foam core 12. The 5½" flat surface of a 2×6 top or bottom plate 16, 18 is adhered to the foam core 12. Similar to the stud-to-foam adhesion, the sheathing 20 is adhered to the foam core 12 where the adhesive 10 is non-continuous across the surface or face of the core and is in 3½" stripes mimicking the stripes of adhesive used to adhere the stud members to the opposing side of the core. The adhesive locks together the individual components of the panel creating a cohesive assembly that takes on a new, unique set of structural properties. By creating a solid bond, completely adhering all members by way of the 3½" wide vertical strip all the way through the thickness of the panel at all locations where the stud members 14 are positioned, the engineering calculations are able to consider all components working together as one rigid body, or as a wall panel assembly.

In a particularly preferred embodiment, mechanical fasteners 30 (FIG. 4) maintain a positive spatial relation between sheathing 20 and stud members 14. These fasteners supplement the structural bond of the adhesive. Mechanical fasteners 30 provide a supplemental and direct connection between inboard flat faced stud members 14 and sheathing 20 by way of penetrating the foam core 12. Mechanical fasteners are preferably inserted first through the exterior sheathing and either lodged into the flat faced interior stud or otherwise positively connected to the flat faced interior stud in such a manner so as to maintain the relative lateral spatial relation therebetween. Mechanical fastener type and spacing can vary by engineering required per unique application. Suitable fasteners include, but are not limited to, screws, nails, pins, barbs, stitching, and molly bolts.

Nailing patterns 24 and 26 mechanically fasten wooden components together. Preferably, these wood-to-wood connections are also bound with adhesive. Adhesive provides a barrier to air filtration between components it adheres.

Figure 5:
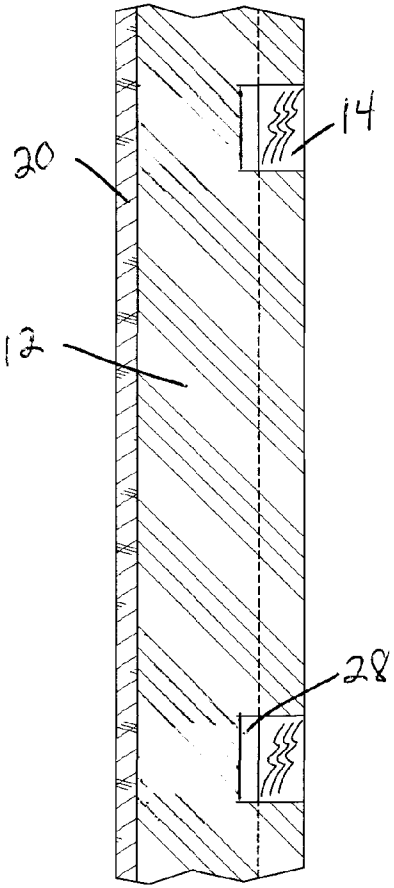
FIG. 5 is a partial side elevational view of a preferred embodiment of a wall panel of the insulated wall panel assembly of the subject invention.

In the exemplified embodiment, the wall panels of the insulated wall panel assembly of the subject invention have one or more electrical chases. The chase 28 is a void in the insulating core, forming a channel open to the face of the panel to which the stud members 14 are adhered (FIG. 5). Electrical wiring is run behind the stud members, inside the foam core and through the chase. The chases can additionally be coated with a rigid material so they maintain their form. The electrical chases are not required if the structure does not include electricity.

The adhesive used in the panels of the subject invention can be any adhesive that will effectively bind the foam and wood structural pieces together and conform to any designated engineering standards. It is important that the adhesive not break down over time, or when there is an environmental change. Suitable adhesives are known in the art.

The wall panel assembly of the subject invention offers a cost effective, energy efficient alternative in building construction. Panels can be customized for use in certain areas of the country or simplified for the do-it-yourselfer. For example, if the sheathing also functioned as finished exterior siding, labor and cost would be greatly reduced. Suitable materials would include all materials known in the art that could act as finished siding and also provide the structural integrity required per assembly engineering.

Fire retardant sprays, membranes, or layers could be incorporated into the panels for use in areas prone to forest or wild fires. Likewise, moisture/mildew resistant sprays membranes, or layers and pest resistant sprays membranes, or layers can be added to panels for use in wet, moist climates. Reflective barriers incorporated into the panels would be ideal for climates in which there are temperature extremes.

Other features that can be incorporated into a panel of the insulated wall panel assembly of the subject invention to increase the panel's usefulness include, but are not limited to, making the base plate 18 treated lumber. An in-wall hydronic radiant PEX pipe system 42, as well as electric radiant heaters, can be positioned inside the wall. The panel of the subject invention can be provided with lateral blocking. SIPs panels discourage lateral blocking.

The insulated wall panel assembly of the subject invention functions as a thermally sound, structural wall panel system. The continuous rigid foam core 12 minimizes conductive thermal transfer. The foam core 12 eliminates thermal bridging through wood stud members, which in this case are located on one side of the insulation, rather than bisecting the insulation and constituting a thermal bridge between interior and exterior surfaces. Applying generous amounts of adhesives between all adjoining panel elements minimizes convective thermal transfer. Continuous adhesive eliminates air infiltration in gaps that would otherwise exist between members.

Collectively, the wall panel assembly constitutes an integral wall building prospect that can be used to build structures of all types, shapes and sizes up to four stories tall in most areas. The subject wall panel construction is a viable alternative to traditional and other prominent wall framing options and offers a cost-effective method of constructing a sound thermal & structural building envelope.

The wall panel assembly of the subject invention can either be manufactured by hand, with or without the aid of jigs or by aid of robotics and mechanized equipment. Mechanized manufacturing preferably includes a material feed system, adhesive applicators and mechanical fastening system. It is preferred that all components be sized prior to assembly. To assemble a panel, the panel height and length is determined. Components are cut appropriately. In an exemplified embodiment, plates 16, 18 are 2×6 lumber, the foam core 12 is 4" POLYISO™ sheet good and sheathing 20 is ½" OSB or plywood. Each is cut to panel length. Foam core 12 and the stud members 14 are cut to the panel height less 3 inches to account for the top and bottom linear plates 16, 18. Adhesive is applied to all connecting surfaces of the respective component members. The component members are placed together to form the assembly. Stud members 14, plates 16, 18 and sheathing 20 are offset from the foam by half a respective interval on the ends so as to allow interlinking between successive panel sections. A perpendicular 2×6 stud is placed on one end of the panel assembly so as to allow interlinking between successive panel sections or otherwise so that the end of the panel can act as the end of a wall section. Once components are positioned and connected with adhesive, mechanical fasteners are placed according to nailing patterns 24, 26 and specialized mechanical fasteners 30 per project specific engineering. The adhesive is given adequate time to cure. While the use of standard jigs, manufacturing tables and mechanized equipment will improve the efficiency of the manufacturing process one skilled in the art will recognize that the same basic steps are followed in all manufacturing methods.

A person or "builder" would use the insulated wall panel assembly of the subject invention to construct buildings. The builder first determines the height and length of the exterior walls for the planned structure and in turn purchases the appropriately sized panels from the local supplier. Once on-site, the panels are cut to the lengths of the wall sections per the plans. Multiple wall sections can be cut from the same panel and alternatively multiple panels may constitute one wall section. Once all wall sections are cut to length, window and door locations are snapped out and cut out with a beam saw. In a particularly preferred embodiment, wall panel sections are offered with pre-cut door and window openings. These openings are then incorporated into the design of the structure being built. If these openings are cut on-site, the foam is then cut back further at door and window locations to allow for bucks and headers to be inserted. Windows, door bucks and headers are installed by working away from an existing flat stud and inserting perpendicular studs and header material in such a manner that replicates traditionally framed wall openings. Once openings are properly bucked, the wall sections are erected, fastened together and fastened to the floor assembly or sill plate connected to the foundation. Panels are fastened together with traditional framing nails, screws and long washer-headed lag screws. Adhesive is placed between joining members to eliminate the possibility of air infiltration. Once the exterior panel walls and the interior stick framed walls are erected, the cap plate is placed linearly on top of the wall assembly around the perimeter of the exterior walls. At this point, trusses or rafters can be placed or alternatively a floor box can be built on top of the walls and a next story is constructed in the same manner as the first.

Figure 9:
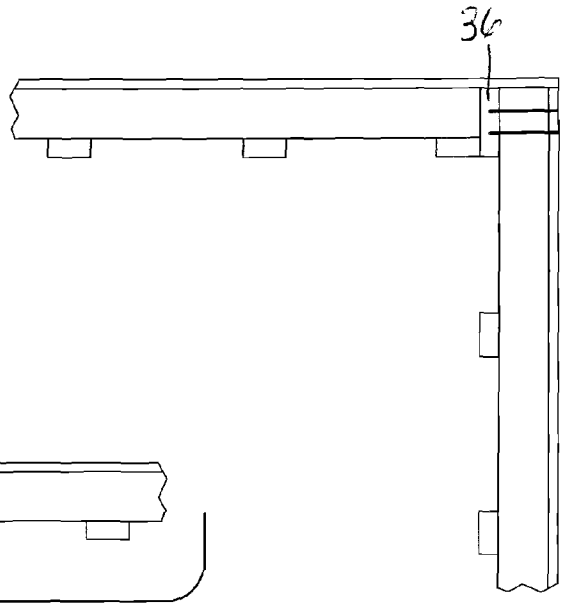
FIG. 9 shows a preferred corner connection of two wall panels of the wall panel assembly of the subject invention.
Figure 7:
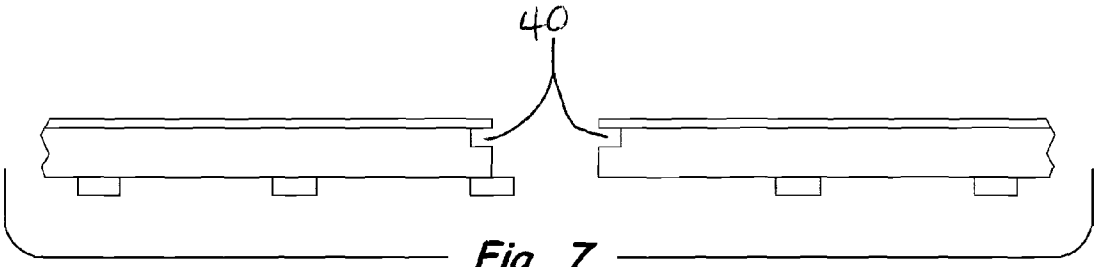
FIG. 7 is a partial side elevational view of a preferred method of connecting two wall panels of a wall panel of the insulated wall panel assembly of the subject invention together.
Figure 8:
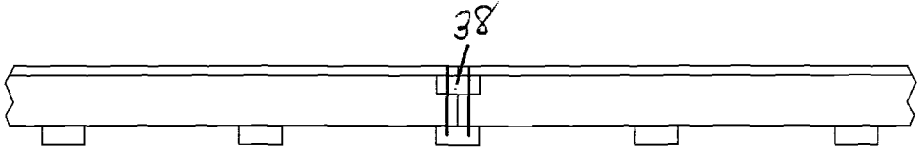
FIG. 8 shows the two wall panels in FIG. 7 joined together.
Figure 10:
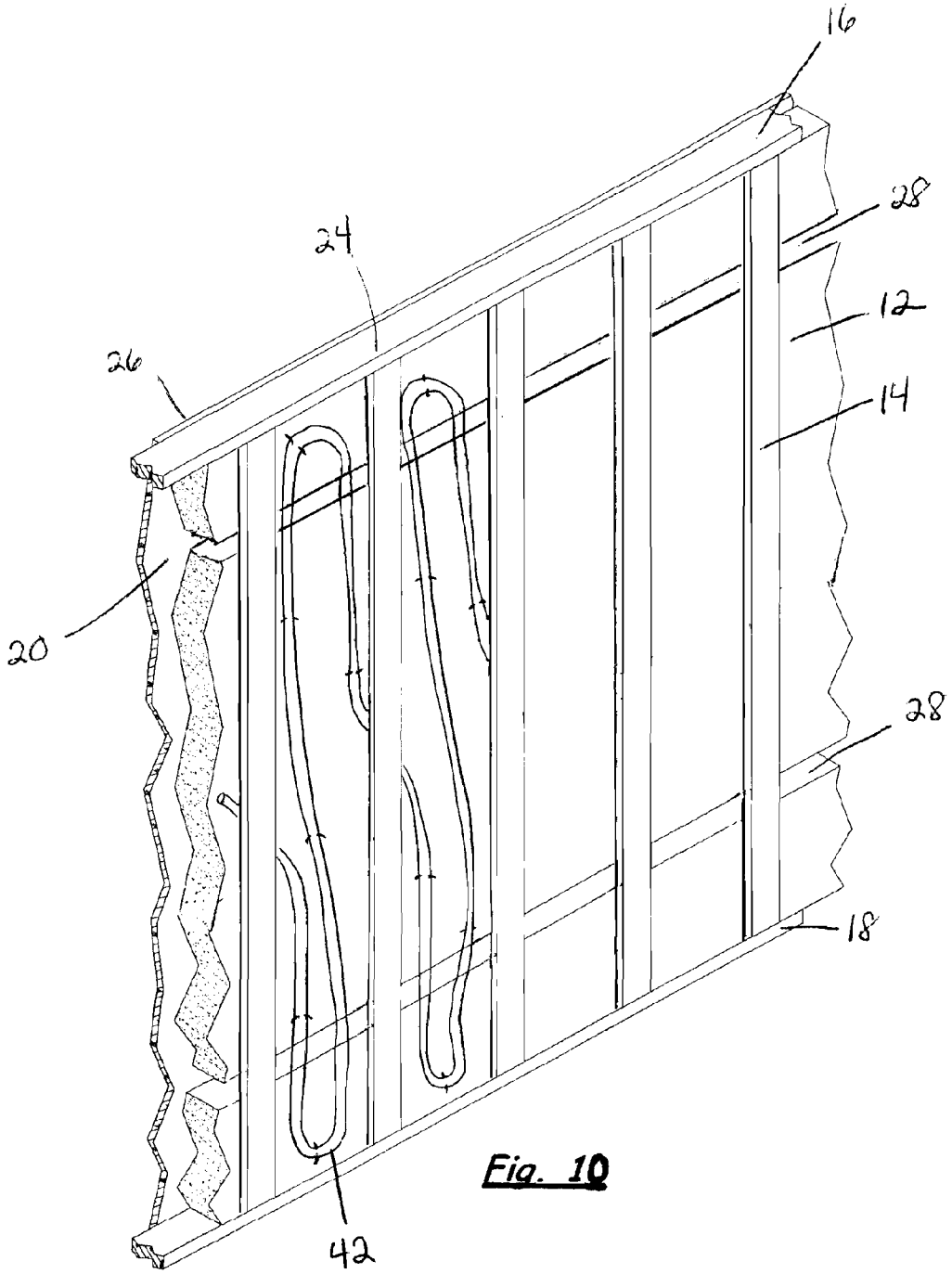
FIG. 10 is a partial perspective view of a preferred embodiment of a wall panel of the insulated wall panel assembly of the subject invention containing in-wall hydronic radiant PEX piping.

The wall panel assembly of the subject invention can be made more easily accessible by standardizing features. For example, wall panels can be sold without top or bottom plates. The plates can be installed in the field making the panels vertically reversible. Electrical chases likewise can be placed equal distances from the top and bottom ends of the panel, for example, at 18", so the panels can be reversed vertically. Connection of adjacent panels is facilitated by providing grooves 40 in panel cores to receive connector studs 38 which are nailed to connect the panels (FIGS. 7-8). Corners are quickly assembled with corner blocks 36 adhered to an edge of a panel that allow pieces to be connected (FIG. 9). To create a corner with a continuous outer sheathing, core material is removed from one panel which receives the perpendicular panel. The non-continuous adhesive adhering the sheathing to the core allows the corner to be created without time consuming and dangerous scooping of toxic foam.

Figure 6:
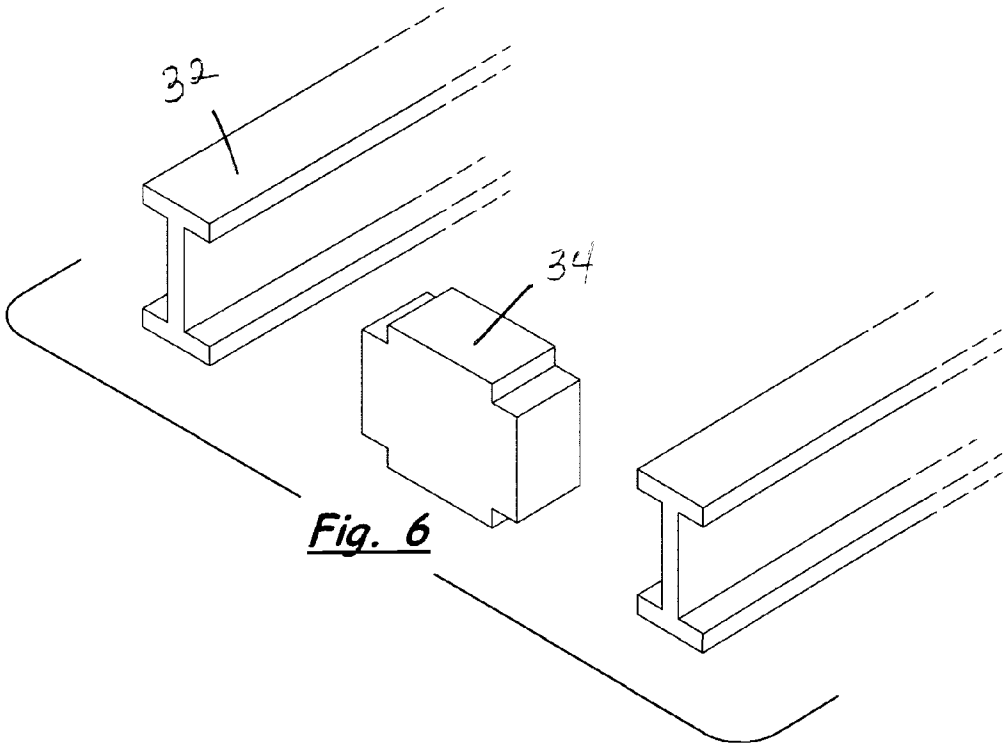
FIG. 6 is a top perspective view of a preferred method of insulating between I-joists.

The insulated wall panel assembly of the subject invention can be engineered for flooring or roofing systems, however this would typically require reconfiguration of the wood studs or added rigid components to meet load requirements. The subject wall panel assembly can be used for interior patrician walls or barriers and is especially useful in applications where thermal or sound transfer between spaces is undesirable. The subject wall panels can be used in such applications as finishing out basements or sister-ed to existing walls for secondary structural support or thermal performance. FIG. 6 shows a unique method of insulating between I-joists 32 when the subject panels are connected to a floor or ceiling using I-joists. A foam block 34 has notches cut into its four corners to receive the cross pieces of each joist. The wall panel assembly of the subject invention is thermally sound in order for the panels to be effective, all parts of the structure should be well insulated.

Advantages of the subject insulated wall panel assembly over available wall panels include, but are not limited to erection and installation are faster eliminating design and manufacturing delay of SIPS and other design-specific competing products. Unlike SIPS, panels of the subject invention offer subsurface blocking for facilitated installation of cabinetry and wall mounted items. The final installed cost of the subject panel assembly is comparable to traditional framing with fiberglass batting insulation. The financial payback is estimated at less than 3 years, a critical factor considered in the design. Currently, paybacks on available products are in excess of 7 years.

A SIP wall is the most popular wall panel currently available, the assembly of the subject invention differs from a SIP wall panel in that the interior structural member of a SIP wall is sheet good preferably OSB, while in the inboard structural member of the panel of the subject invention is vertical flat laid wood studs placed on layout. SIPs use insulating foam in its core that is expanded polystyrene (EPS).

It is preferred that the wall panel of the subject invention use high-performance urethane based rigid sheet foam such as a POLYISO™ board as the insulating core. Unlike SIPS, the adhesive used to lock the sheathing to the core in the panel assembly of the subject invention is non-continuous. Mechanical fasteners can be used to supplement the adhesion in order to meet bearing, sheer, out-of-plane and other engineering and load requirements. Unlike SIPs, the panels of the wall panel assembly of the subject invention will be readily available at retail stores and come in standard sizes. SIPs are customized to the design at the factory.

The insulated wall panel assembly system of the subject invention is in a variety of standard sizes, conducive to standard wall heights. Customization takes place in the field, rather than at a factory. Further, such negatives as toxic foam scooping, the cost and time delay of an additional engineering and drawing phase, wasted rigid insulation, lack of sub-surface blocking and the difficulty of field modifications are avoided. The subject panels are precision produced for square, plumb building envelopes. The job of the insulation contractor is nearly eliminated, while the building work of other involved trades; primarily the electrician, roofer and siding installer is simultaneously expediting. Advanced options using this design further allow for exterior siding to be integrated with the panel assembly at the factory level. This greatly reduces siding costs and additional construction time in process. Of all the advantages offered, the relatively low cost of the subject assembly is most advantageous.

It is understood that the foregoing examples are merely illustrative of the present invention. Certain modifications of the articles and/or methods employed may be made and still achieve the objectives of the invention. Such modifications are contemplated as within the scope of the claimed invention.

The invention claimed is:

1. A structural wall panel comprising:

a generally planar insulating core, the core comprising one planar surface and an opposing planar surface with a thickness therebetween, one edge and an opposing edge, and one end and an opposing end;

a plurality stud members having a length, a width, and a depth, the length of each stud member being a length of the insulating core from one end to the opposing end, the depth of each stud member defining a front and a rear of the stud member, and the width of each stud member defining opposing sides of the stud member, one of the opposing sides of each stud member adhered to the one planar surface in a spaced relationship from the one edge of the insulating core, each stud member having one end and another end;

a first plate adhered along the one end of the insulating core overlaying and connected to the one end of each stud member;

a second plate adhered along the opposing end of the insulating core overlaying and connected to the another end of each stud member;

sheathing covering and adhered to the opposing planar surface of the insulating core, the sheathing covering and connected to the first plate and the second plate, adhesive adhering the sheathing to the opposing planar surface of the insulating core is non-continuous and is in the same spaced relationship of the plurality of stud members on the one planar surface of the insulating core; and at least one cap plate, the at least one cap plate disposed along at least one of the first plate and the second plate and overlaying and directly connected to an end of the sheathing;

wherein the thickness of the insulating core combined with the width of the stud are substantially equal to a depth of the first or second plate, and the insulating core provides structural integrity, the studs provide lateral and sheer integrity, the first plate, the second plate, and the cap plate disperse vertical loads across the vertical flat laid studs and the insulating core, and the sheathing provides bearing and sheer integrity to create a wall panel assembly that is a structural wall.

2. The wall panel assembly of claim 1, wherein at least one of said first plate and said second plate is connected to each stud member by mechanical fasteners.

3. The wall panel assembly of claim 1, wherein said sheathing is connected to at least one of said first plate and said second plate by adhesive.

4. The wall panel assembly of claim 1, wherein said sheathing is connected to at least one of said first plate and said second plate by mechanical fasteners.

5. The wall panel assembly of claim 1, wherein said sheathing is connected to at least one of said first plate and said second plate by adhesive and mechanical fasteners.

6. The wall panel assembly of claim 1, wherein said cap is connected to at least one of said first plate and said second plate by adhesive and mechanical fasteners.

7. The wall panel assembly of claim 1, wherein said cap is connected to said sheathing by adhesive and mechanical fasteners.

8. The wall panel assembly of claim 1, further comprising at least one mechanical fastener inserted into said sheathing, penetrating through said insulating core, and connected to at least one of said stud members.

9. The wall panel assembly of claim 1, further comprising at least one chase that is an open channel to said one planar surface of said insulating core.

10. The wall panel assembly of claim 1, wherein said sheathing is exterior grade siding.

11. The wall panel assembly of claim 1, further comprising at least one spray, membrane, or layer selected from the group consisting of fire retardant, moisture resistant, mildew resistant, and pest resistant.

12. The wall panel assembly of claim 1, wherein at least one of said first plate and said second plate is treated lumber.

13. The wall panel assembly of claim 1, further comprising a reflective layer.

14. The wall panel assembly of claim 1, further comprising lateral blocking.

15. The wall panel assembly of claim 1, further comprising in-wall hydronic radiant PEX pipe.

16. The wall panel assembly of claim 1, wherein at least one edge of said insulating core further comprises a groove to receive a connecting member, the connecting member used to attach said wall panel assembly to an adjacent wall panel assembly.

* * * * *